US011581665B2

(12) United States Patent
Eriksen

(10) Patent No.: US 11,581,665 B2
(45) Date of Patent: Feb. 14, 2023

(54) COAXIAL CONNECTOR HAVING AN OUTER CONDUCTOR ENGAGER

(71) Applicant: PPC BROADBAND, INC., East Syracuse, NY (US)

(72) Inventor: Kim Lundgren Eriksen, Tappernøje (DK)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 17/144,137

(22) Filed: Jan. 7, 2021

(65) Prior Publication Data

US 2021/0210875 A1 Jul. 8, 2021

Related U.S. Application Data

(60) Provisional application No. 62/958,233, filed on Jan. 7, 2020.

(51) Int. Cl.

| | |
|---|---|
| ***H01R 9/05*** | (2006.01) |
| ***H01R 13/52*** | (2006.01) |
| ***H01R 24/40*** | (2011.01) |

(52) U.S. Cl.

CPC ..... *H01R 9/0518* (2013.01); *H01R 13/5202* (2013.01); *H01R 24/40* (2013.01)

(58) Field of Classification Search

CPC .. H01R 9/0518; H01R 13/5202; H01R 24/38; H01R 24/40

See application file for complete search history.

(56) References Cited

U.S. PATENT DOCUMENTS 7,347,729 B2 * 3/2008 Thomas ..... H01R 9/053 439/583
7,351,101 B1 * 4/2008 Montena ..... H01R 24/564 439/584

(Continued)

FOREIGN PATENT DOCUMENTS

WO 2016201165 A1 12/2016

OTHER PUBLICATIONS

Search Report dated Mar. 26, 2021 in corresponding International Application No. PCT/US2021/012564, 4 pages.

(Continued)

*Primary Examiner* — Oscar C Jimenez

(74) *Attorney, Agent, or Firm* — MH2 Technology Law Group LLP

(57) ABSTRACT

A connector for a coaxial cable includes a coupler configured to engage another coaxial cable connector, a body configured to be disposed at least partially within the coupler, and an outer conductor engager made of a conductive material disposed within the body and the coupler. An interior of the body includes a biasing element, and a compression sleeve is disposed at an opposite axial side of the outer conductor engager relative to the biasing element. The compression sleeve, the outer conductor engager, and the body are configured such that opposite axial forces applied to the compression sleeve and the outer conductor engager cause the outer conductor engager to move axially relative to one another and to cause the outer conductor engager to move axially relative to the body when the connector is coupled to the coaxial cable. The outer conductor engager is configured to be compressed by the biasing member when the outer conductor engager portion moves relative to the body such that an interior surface of the (Continued)

outer conductor engager portion is compressed radially inward against an outer conductor of the coaxial cable.

29 Claims, 9 Drawing Sheets

(56) References Cited

U.S. PATENT DOCUMENTS

| | | | | |
|---|---|---|---|---|
| 10,418,760 | B2 * | 9/2019 | Watkins | H01R 24/38 |
| 2008/0081512 | A1 | 4/2008 | Chawgo | |
| 2016/0365683 | A1 * | 12/2016 | Watkins | H01R 13/501 |
| 2017/0317456 | A1 * | 11/2017 | Watkins | H01R 9/0527 |

OTHER PUBLICATIONS

Written Opinion dated Mar. 26, 2021 in corresponding International Application No. PCT/US2021/012564, 8 pages.

* cited by examiner

COAXIAL CONNECTOR HAVING AN OUTER CONDUCTOR ENGAGER

CROSS-REFERENCE TO RELATED APPLICATIONS

The application claims priority and benefit of U.S. Provisional Application No. 62/958,233, filed Jan. 7, 2020, which is hereby incorporated by reference in its entirety.

TECHNICAL FIELD

The present disclosure relates to connectors for coaxial cables and, more particularly, to a post-less coaxial cable connector.

BACKGROUND

A coaxial cable is prepared for connection to another cable, or to another RF device, by a coaxial cable connector. Coaxial cable connectors must be securely crimped to coaxial cables to which they are attached. The crimp must at least mechanically secure the connector to the cable, and it is also desirable for the crimp to block out moisture. Preparation of the connector/cable typically requires the use of several specialized tools including a stripping tool and a compression tool. The stripping tool removes a portion of the compliant outer jacket to expose a signal-carrying inner conductor and an outer grounding, or braided, conductor of the cable. The compression tool, on the other hand, inserts a grounding/retention post into the prepared end of the cable to effect an electrical and mechanical connection between the cable and an outer body or housing of the cable connector.

The step of compressing/inserting the grounding/retention post into the prepared end of the coaxial cable also requires a holding fixture to align the prepared end of the cable while a driver compresses a barbed annular sleeve of the grounding/retention post into/beneath the outer jacket of the cable. As such, the outer jacket may be compressed between the barbed annular sleeve and a fixed-diameter outer housing of the cable connector. Compression of the outer jacket causes the barbed annular sleeve to engage the braided conductor of the cable, thereby retaining the grounding/retention post of the connector to the coaxial cable.

Post-less connectors have been recently introduced. Current designs feature a body which collapses under axial force and forms a sharp crimp that engages the exterior of the braided outer conductor.

Post-based crimping connectors have the disadvantages of being difficult to assemble and potentially damaging to the coaxial cable. Current post-less designs have the disadvantages of being expensive to manufacture and providing an inferior seal and coupling when certain forces are applied to the cable. There remains a need in the art for an improved post-less coaxial cable connector.

SUMMARY

According to various embodiments of the disclosure, a connector for a coaxial cable includes a coupler configured to engage another coaxial cable connector, a body configured to be disposed at least partially within the coupler, and an outer conductor engager made of a conductive material disposed within the body and the coupler. An interior of the body includes a biasing element, and a compression sleeve is disposed at an opposite axial side of the outer conductor engager relative to the biasing element. The compression sleeve, the outer conductor engager, and the body are configured such that opposite axial forces applied to the compression sleeve and the outer conductor engager cause the outer conductor engager to move axially relative to one another and to cause the outer conductor engager to move axially relative to the body when the connector is coupled to the coaxial cable. The outer conductor engager is configured to be compressed by the biasing member when the outer conductor engager portion moves relative to the body such that an interior surface of the outer conductor engager portion is compressed radially inward against an outer conductor of the coaxial cable.

In some aspects, the outer conductor engager further includes a flange on an exterior of the outer conductor engager portion that is compressed by the biasing element during coupling of the connector to the coaxial cable.

In various aspects, the outer conductor engager portion further includes fingers that are configured to be inwardly compressed by the biasing element during the coupling of the connector to the coaxial cable.

According to some aspects, the connector further includes a sealing member retained between the coupler portion and the body portion.

In various aspects, the connector further includes an insert sleeve disposed inside the compression sleeve, and the compression sleeve is configured to compress the insert sleeve against the coaxial cable when the axial force is applied to the compression sleeve.

In some aspects, the biasing element is a radially inward lip.

According to various embodiments of the disclosure, a connector for a coaxial cable includes a coupler configured to engage another coaxial cable connector, a body configured to be disposed at least partially within the coupler, an outer conductor engager made of a conductive material disposed within the body and the coupler, and a compression sleeve at an opposite axial side of the outer conductor engager relative to the coupler. The compression sleeve, the outer conductor engager, and the body are configured such that opposite axial forces applied to the compression sleeve and the outer conductor engager cause the outer conductor engager to move axially relative to one another and to cause the outer conductor engager to move axially relative to the body when the connector is coupled to the coaxial cable. The outer conductor engager is configured to be compressed by the biasing member when the outer conductor engager portion moves relative to the body such that an interior surface of the outer conductor engager portion is compressed radially inward against an outer conductor of the coaxial cable.

In some aspects, a radially inward lip extends from an interior of the body. According to various aspects, the outer conductor engager further includes a flange on an exterior of the outer conductor engager portion. In various aspects, the flange is configured to be compressed by the radially inward lip during coupling of the connector to the coaxial cable. According to some aspects, the flange includes fingers that are configured to be inwardly compressed by the radially inward lip during the coupling of the connector to the coaxial cable.

According to various aspects, the connector further includes a sealing member retained between the coupler portion and the body portion.

According to some aspects, the connector further includes an insert sleeve disposed inside the compression sleeve, and the compression sleeve is configured to compress the insert sleeve against the coaxial cable when the axial force is applied to the compression sleeve.

According to various embodiments of the disclosure, a connector for a coaxial cable includes a coupler configured to engage another coaxial cable connector, a body configured to be disposed at least partially within the coupler, and an outer conductor engager made of a conductive material disposed within the body and the coupler. The outer conductor engager is configured to be moved axially relative to the body when the connector is coupled to the coaxial cable, and the outer conductor engager is configured to be compressed by an interior surface of the body when the outer conductor engager portion moves relative to the body such that an interior surface of the outer conductor engager portion is compressed radially inward against an outer conductor of the coaxial cable.

In some aspects, the connector further includes a compression sleeve at an opposite axial side of the outer conductor engager relative to the coupler. According to some aspects, a radially inward lip extends from an interior of the body. According to various aspects, the outer conductor engager further includes a flange on an exterior of the outer conductor engager portion. In various aspects, the flange is configured to be compressed by the radially inward lip during coupling of the connector to the coaxial cable. According to some aspects, the flange includes fingers that are configured to be inwardly compressed by the radially inward lip during the coupling of the connector to the coaxial cable.

According to various aspects, the connector further includes a sealing member retained between the coupler portion and the body portion.

According to some aspects, the connector further includes an insert sleeve disposed inside the compression sleeve, and the compression sleeve is configured to compress the insert sleeve against the coaxial cable when the axial force is applied to the compression sleeve.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
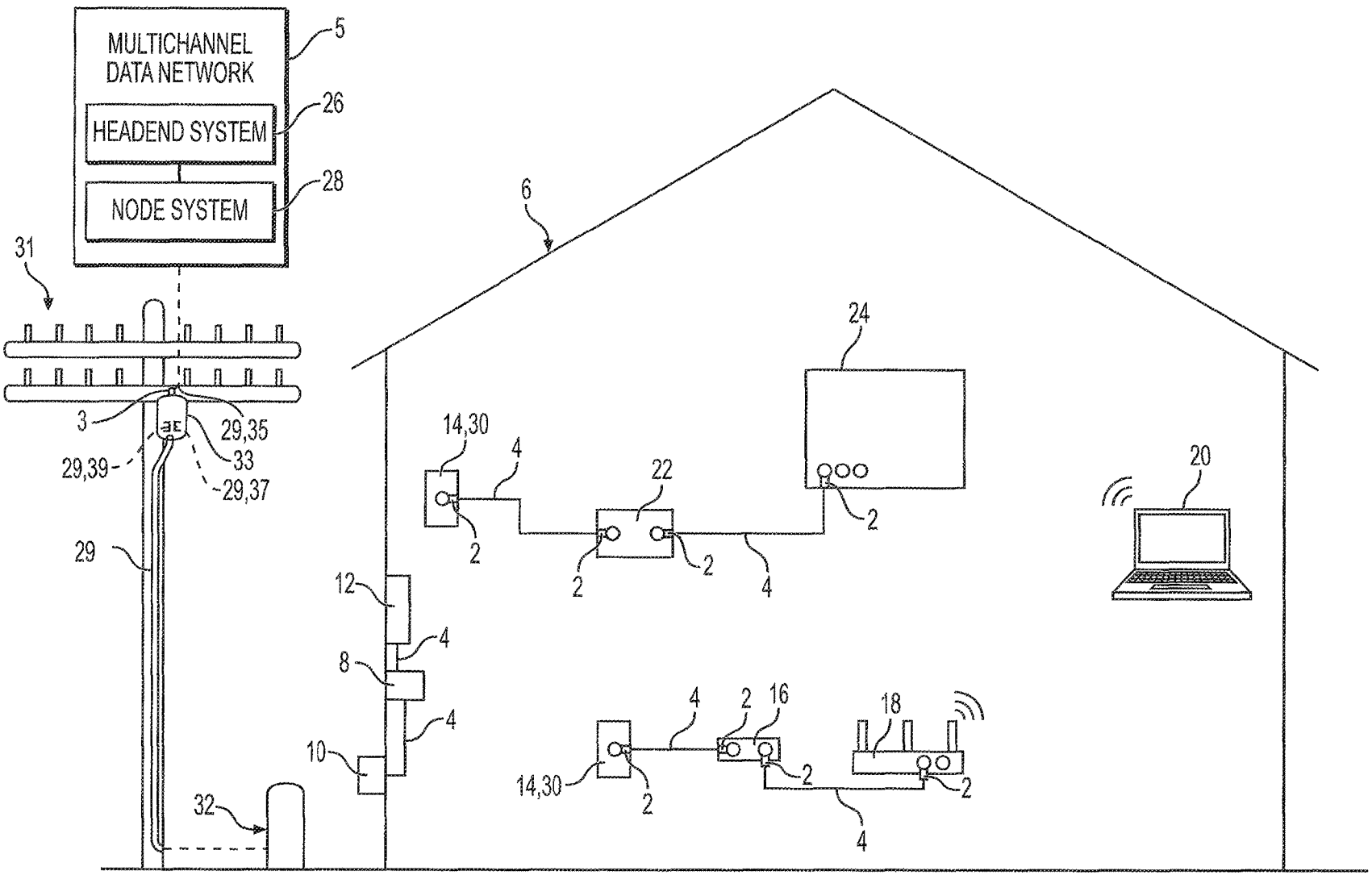
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue, or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
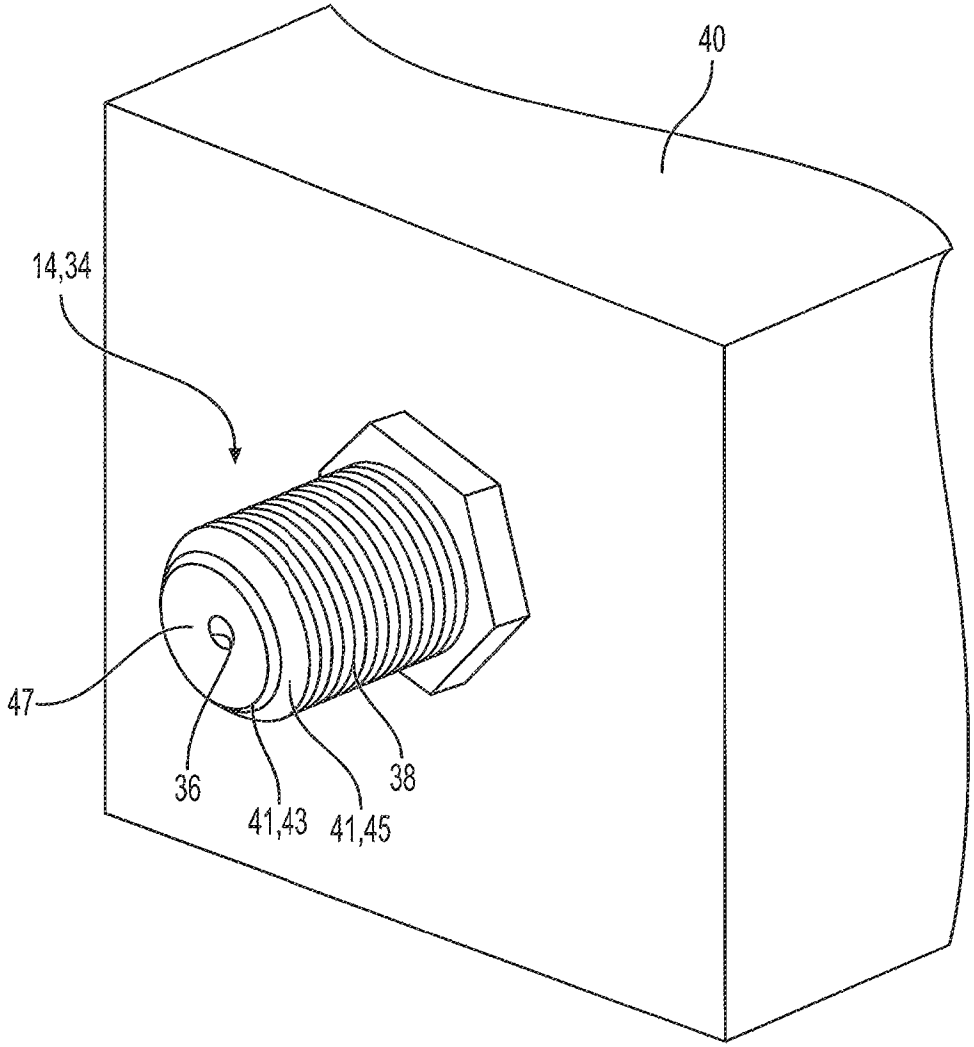
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
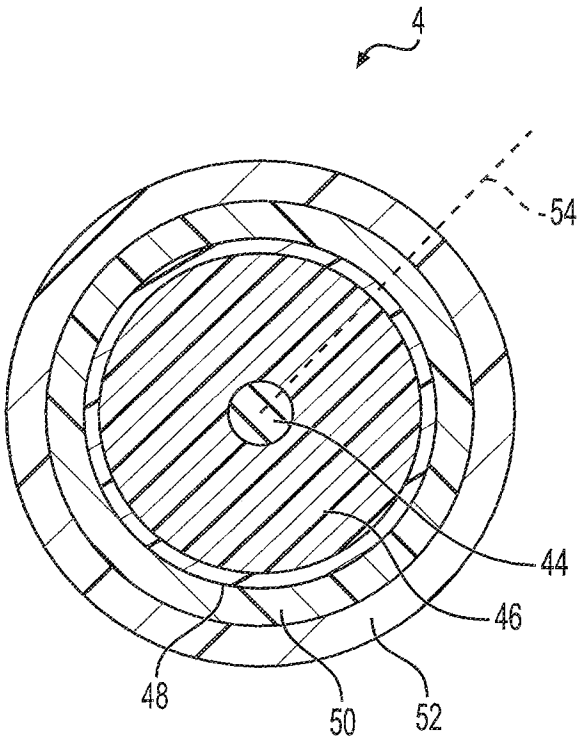
FIG. 4 is a cross-sectional view of the exemplary coaxial cable of FIG. 3.
Figure 3:
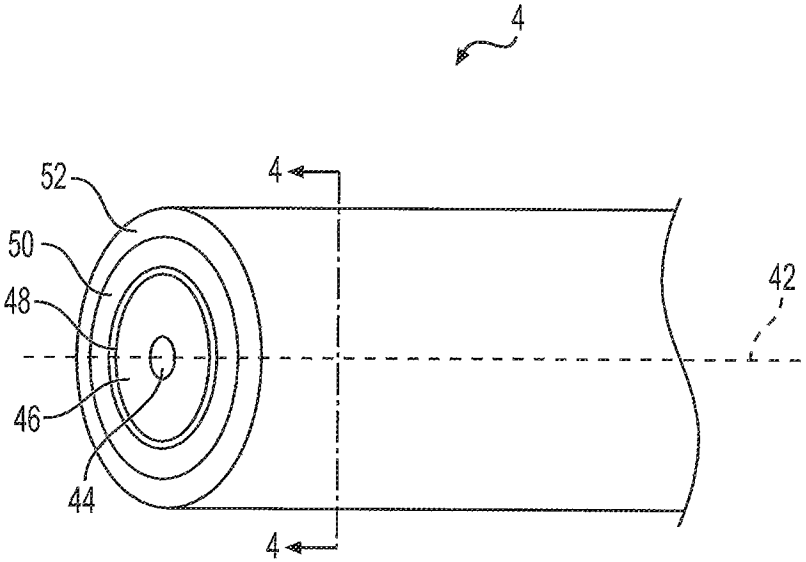
FIG. 3 is a perspective view of an exemplary coaxial cable in accordance with various aspects of the disclosure.
Figure 5:
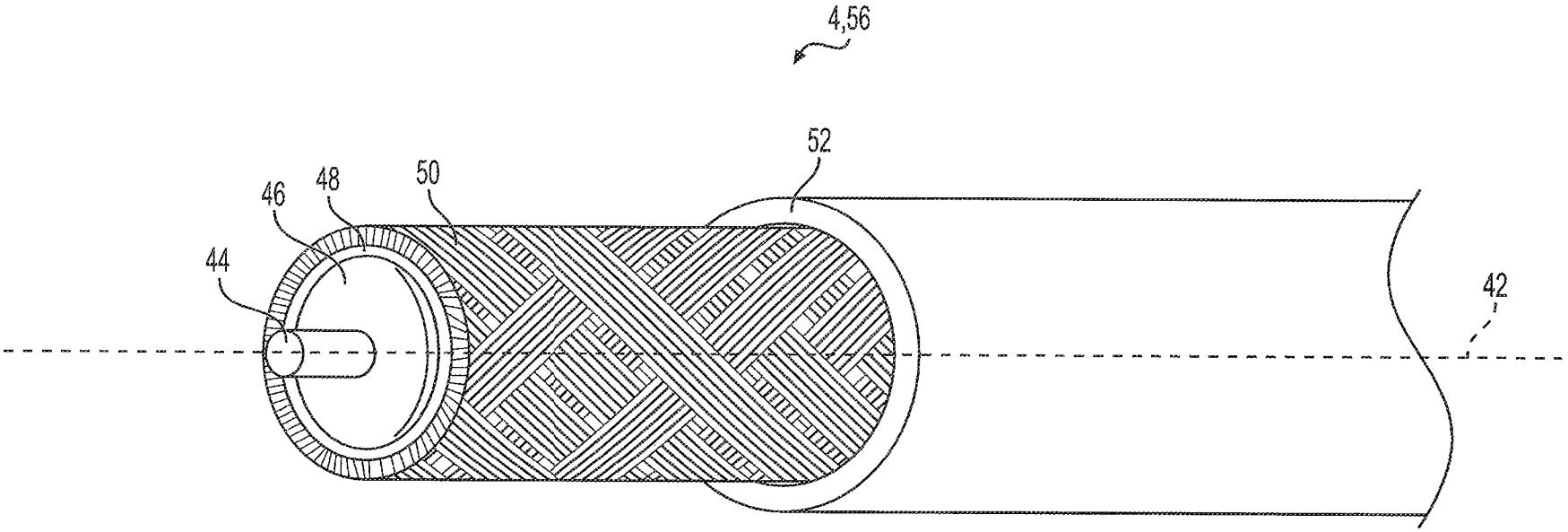
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
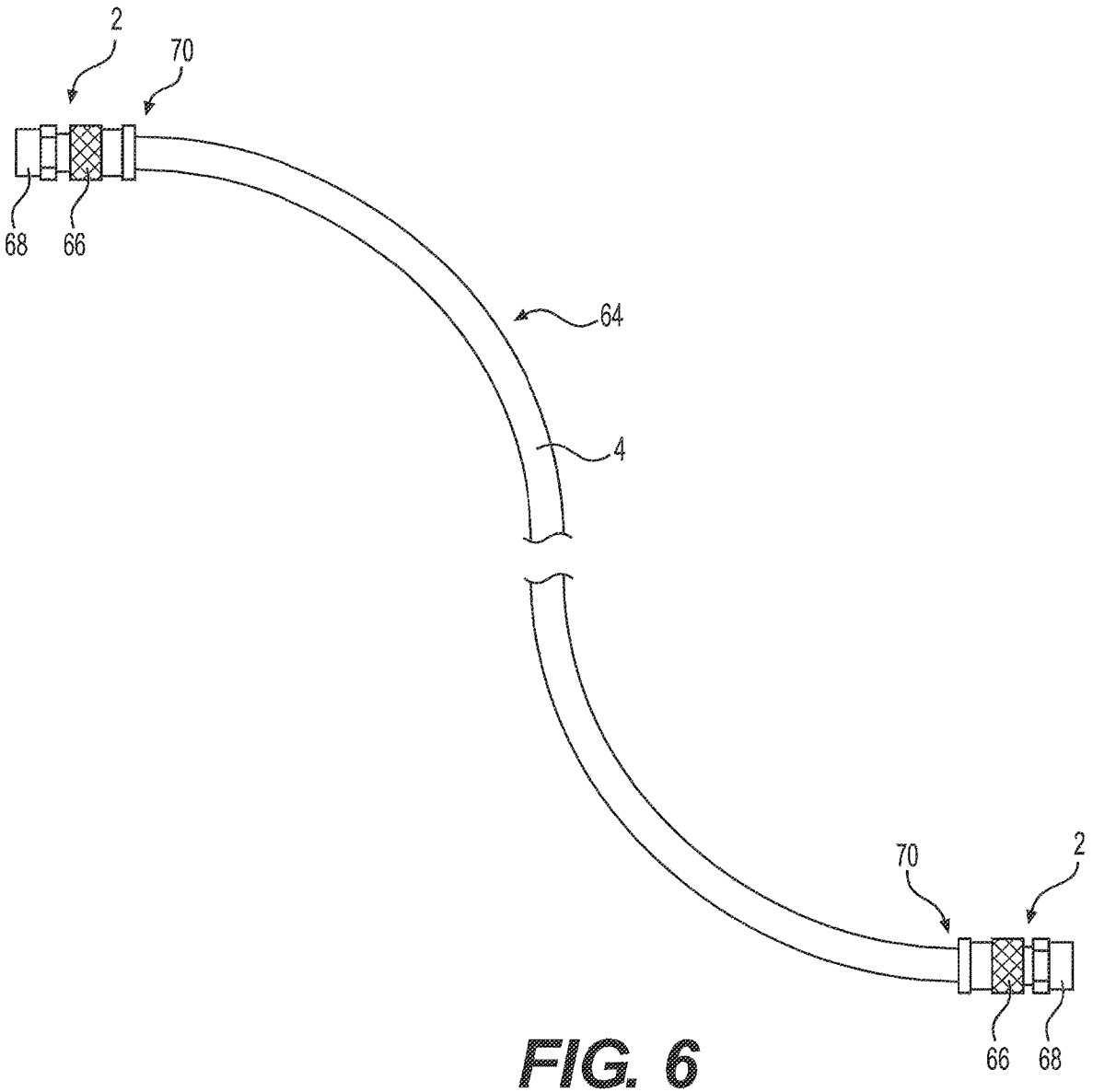
FIG. 6 is a top view of one embodiment of a coaxial cable jumper or cable assembly which is configured to be operatively coupled to the multichannel data network.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector of the present disclosure provides a reliable electrical ground, a secure axial connection and a watertight seal across leakage-prone interfaces of the coaxial cable connector.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

Figure 7:
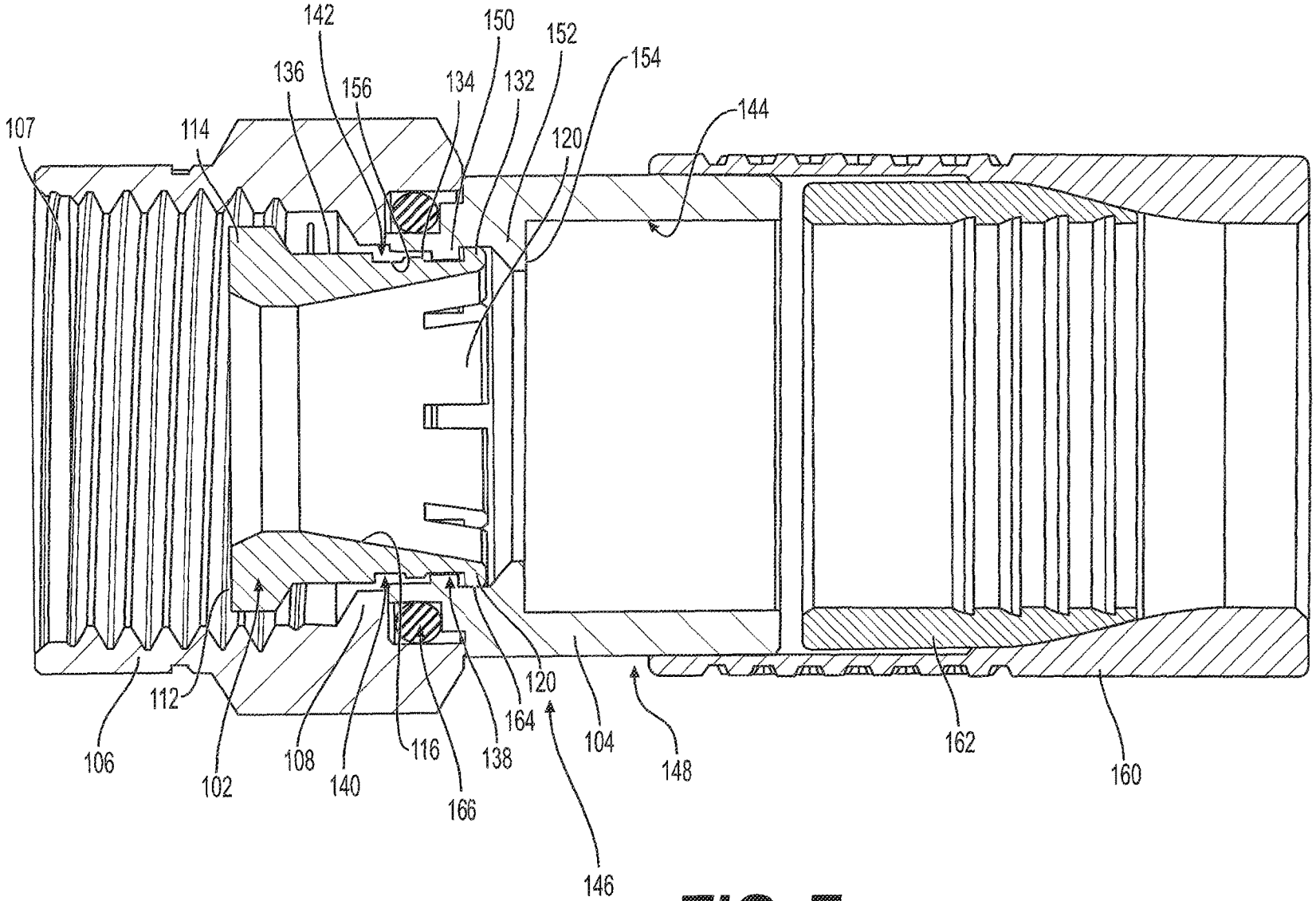
FIG. 7 is a sectional view of an exemplary connector disposed in an uncompressed configuration.
Figure 8:
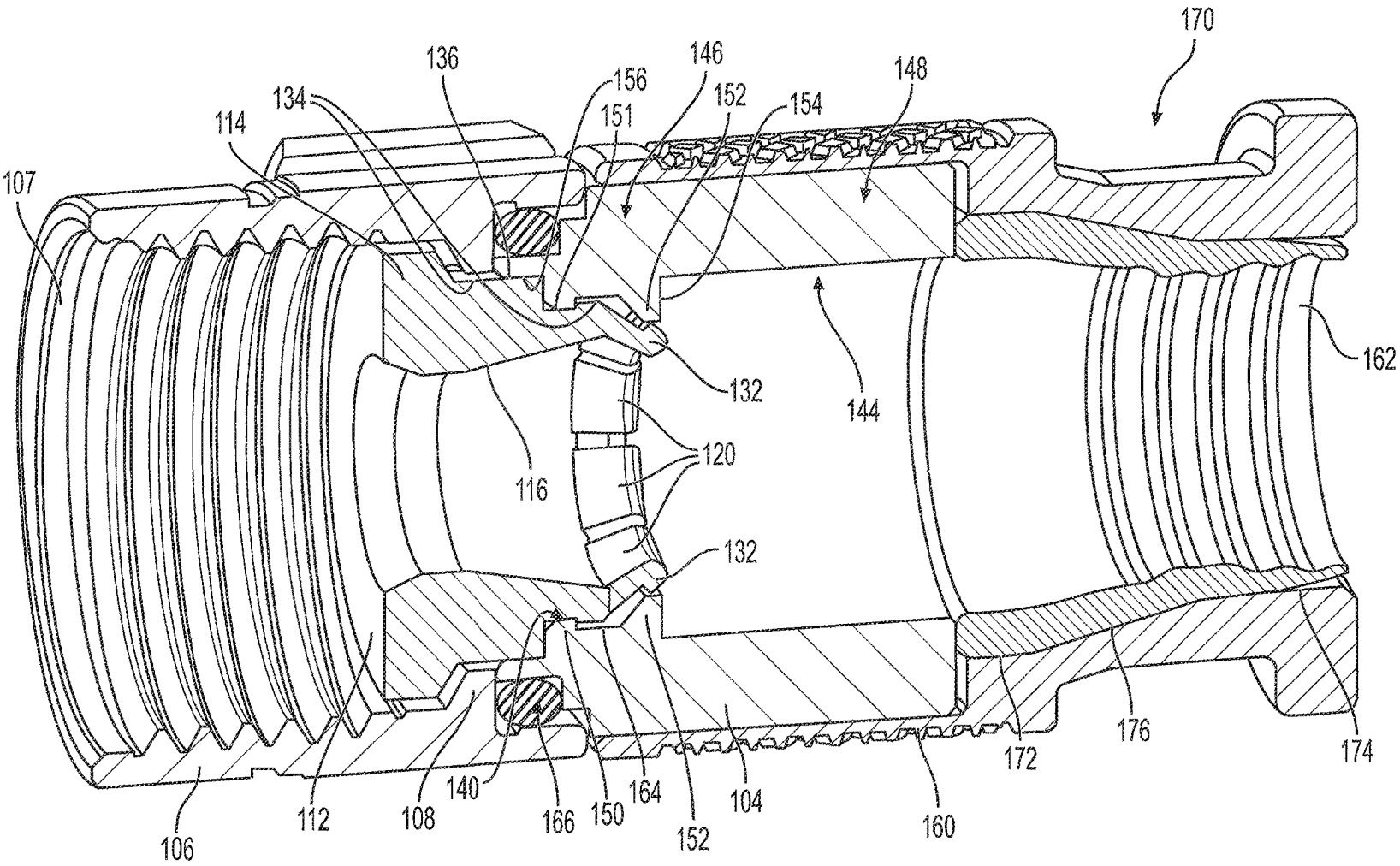
FIG. 8 is a perspective sectional view of the connector of FIG. 7 disposed in a compressed configuration.
Figure 9:
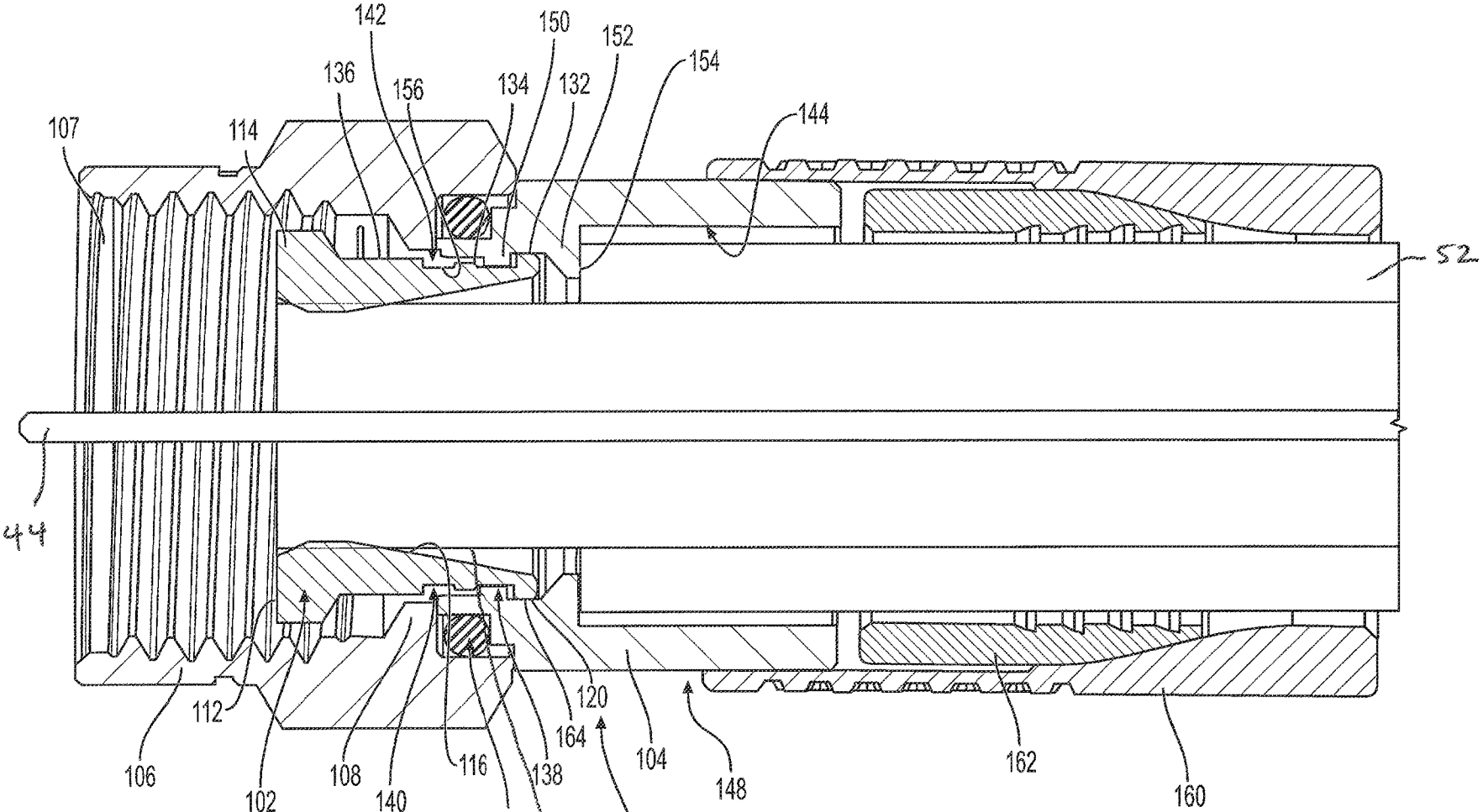
FIG. 9 is a sectional view of an exemplary connector disposed in an uncompressed configuration with a coaxial cable inserted.

According to the disclosure, the aforementioned connectors 2 may be configured as coaxial cable connector 100, as illustrated in FIGS. 7-9. When the connector 100 is installed on an interface port 14, a forward end, portion, or direction is proximal to, or toward, the interface port 14, and a rearward end, portion, or direction is distal, or away, from the interface port 14.

Connector 100 is a connector configured to be coupled to a coaxial cable. When coupled to a coaxial cable, connector 100 is both mechanically and electrically coupled to a coaxial cable in an interior portion of connector 100. This mechanical and physical connection is imparted by post (i.e. engager) 102, which engages the coaxial cable. In several embodiments, post 102 is constructed from a conductive material in order to create an electrical connection between the outer conductor 50 and threaded coupler (i.e. nut) 120, which is adapted to connect to a male coaxial connector.

For purposes of this disclosure, with reference to the connector 100, a pre-installed or uninstalled state or configuration refers to the connector 100 before it is coupled with the coaxial cable 4 and the interface port 14. A partially-installed/assembled state refers to the connector 100 when it is coupled with the coaxial cable 4, but not with the interface port 14. An installed or fully-installed state refers to the connector 100 when it is coupled with the coaxial cable 4 and the interface port 14.

Referring now to FIGS. 7 and 8, the coaxial cable connector 100 includes an outer conductor engager 102, a connector body or housing 104, and a threaded coupler 106. The outer conductor engager 102 includes a forward flange 114 having a forward-facing front face surface 112 for electrically engaging a face surface of an interface port 14 (described in more detail below) and for retaining an internal lip of the coupler 106. The outer conductor engager 102 includes an inner surface portion 116 that tapers from a rearward end toward a forward end. At the forward end of the tapered inner surface portion 116, the outer conductor engager 102 defines an aperture 110 for accepting a portion of the coaxial cable 4.

The outer conductor engager 102 includes a plurality of resilient fingers 120 at its rearward end for engaging a peripheral outer surface of the braided outer conductor 50 of the coaxial cable 4. In the described embodiment, each resilient finger 120 includes an outward-facing flange 132 at the rearward end of the outer conductor engager 102, i.e., the end which is distal, or away, from the front face surface 112 of the outer conductor engager 102. Forward of the flanges 132, the outer conductor engager 102 includes a ridge 134 extending from its outer surface 136. The ridge 134 and the flanges 132 cooperate to define a first annular groove 138 on the outer surface 136 of the outer conductor engager 102. Forward of the ridge 134, the outer surface 136 of the outer conductor engager 102 defines a rearward-facing shoulder 140. The shoulder 140 and the ridge 134 cooperate to define a second annular groove 142 that is forward of the first annular groove 138.

In the described embodiment, the tapered inner surface portion 116 is structured and arranged to electrically engage and collect the outer or external peripheral surface of the braided conductor 50 of the coaxial cable 4 when the braid is not folded back onto the jacket 52. The plurality of resilient fingers 120 also facilitate electrical grounding and retention of the coaxial cable 4 when a radial load displaces the resilient fingers 120 against the braided outer conductor 50 of the coaxial cable 4, for example, in the installed state, as discussed in more detail below.

The connector body 104 defines an aperture 144 for receiving a portion of the coaxial cable 4. The body 104 includes a forward annular ring portion 146 and a rearward annular ring portion 148. The rearward annular ring portion 148 is configured to engage a compression ring 160. An insert sleeve 162 is disposed in the compression ring 160 and is structured and arranged to be compressed onto the jacket 52 of the cable 4 to seal and grip the jacket 52. The insert sleeve 162 may be a flexible plastic sleeve configured to provide a sealing engagement with the compression ring 160 and the jacket 52 of the cable 4 when the connector is installed on the cable 4.

The forward annular ring portion 146 includes a flange 152 that extends radially inward and defines a rearward-facing surface 154 that is structured and arranged to be a stop surface for the jacket 52 of the cable 4 when terminating the cable 4 with the connector 100. The flange 152 is configured to biasingly engage the fingers 120 when the connector 100 terminates the cable 4, as discussed below. The forward annular ring portion 146 also includes an annular projection 150 that extends radially inward from an inner surface 156 of the forward annular ring portion 146. Before the connector 100 is used to terminate the cable 4, the projection 150 is disposed in the first annular groove 138, and when the connector 100 terminates the cable 4, the projection 150 is disposed in the second annular groove 142.

The threaded coupler 106 includes a threaded portion 107 at its forward end for threadedly engaging the threaded outer surface 38 of the interface port 14. A rearward end of the threaded coupler 106 includes a flange 108 that is bearing-mounted to the forward flange 114 of the outer conductor engager 102 such that the coupler 106 is rotatable relative to the outer conductor engager 102 and the connector body 104. A seal 166 may be disposed between the body 104 and the coupler 106 to prevent moisture and contaminants from entering the connector 100.

Having described the components of the connector 100 in detail, the use of connector 100 in terminating a coaxial cable 4 is now described. Cable 4 is prepared in conventional fashion for termination, as described above in connection with FIG. 5.

As shown in FIGS. 7 and 9, when the connector is in the pre-installed state, the projection 150 of the forward annular ring portion 146 is disposed in the first annular groove 138 between the flanges 132 and the ridge 134. The plurality of fingers 120 are in a radially expanded configuration, and the flanges 132 of the fingers 120 are disposed in an annular groove 164 between the projection 150 and the flange 152. These cooperative arrangements and the bearing mount between the flange 108 of the threaded coupler 106 and the forward flange 114 of the outer conductor engager 102 couple the outer conductor engager 102, the body 104, and the coupler 106 together in the pre-installed state. The prepared cable 4 (FIG. 5) is inserted into the rear end of the connector 100 and through the aperture 144 of the body 104 until the braided outer conductor 50 extends into the outer conductor engager 102 and engages the tapered inner surface portion 116, which collects and compresses the outer conductor engager 102 in a radially inward direction.

Referring now to FIG. 8, an installed state of the connector 100 is illustrated. In order to transition the connector 100 to the installed state, a conventional compression tool (not shown) is employed. As would be understood by persons skilled in the art, the compression tool is used to effectuate relative axial movement between the outer conductor engager 102 and the body 104 and between the compression ring 160 and the body 104.

Figure 10:
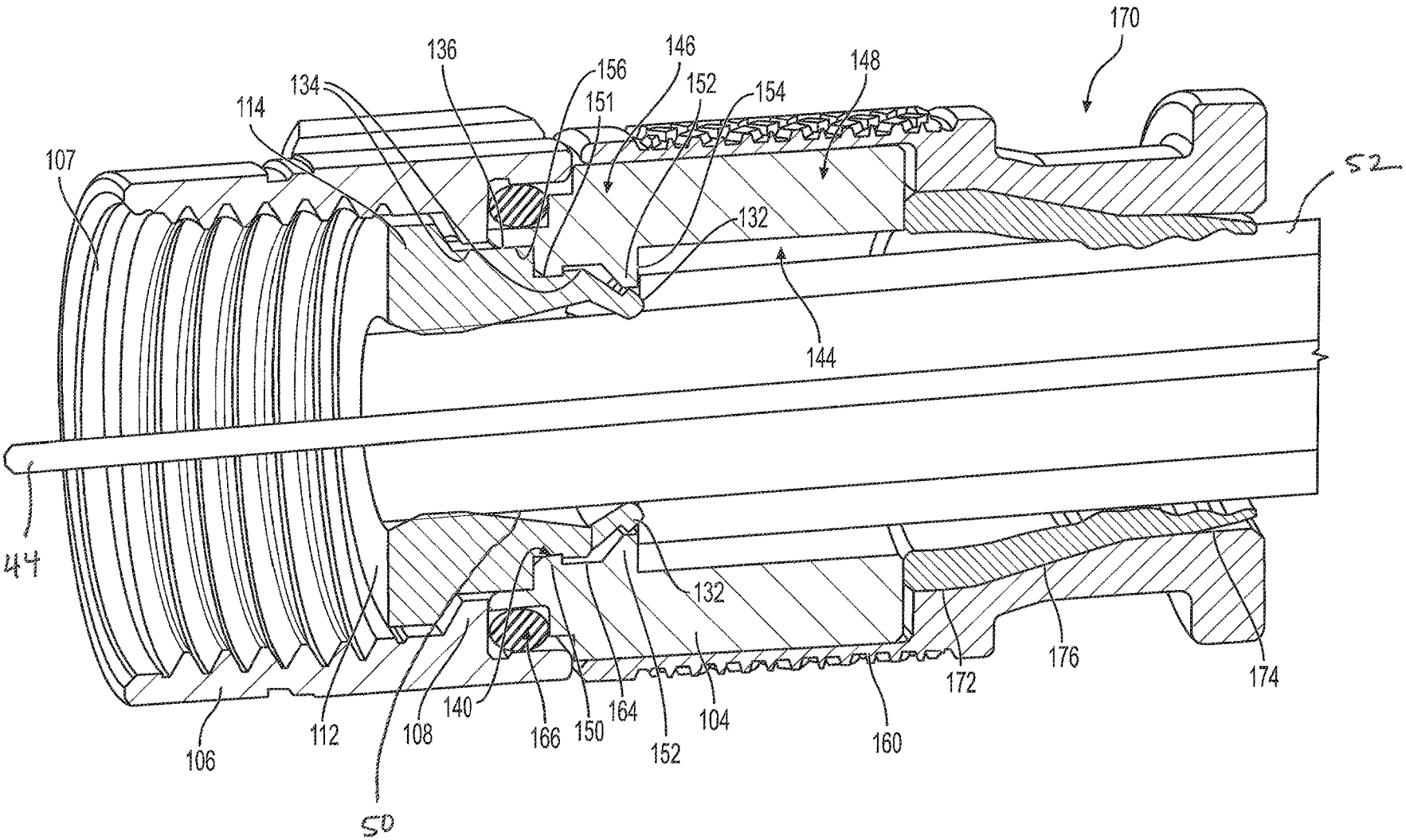
FIG. 10 is a perspective sectional view of the connector of FIG. 7 disposed in a compressed configuration on a coaxial cable.

As shown in FIGS. 8 and 10, in the installed state, the outer conductor engager 102 moves rearward relative to the body 104. As the outer conductor engager 102 is moved rearward, the projection 150 is urged out of the first groove 138 and past the ridge 134 into the second groove 140. The axially forward end of the projection 150 may include a tapered surface 151 that facilitates the movement of the projection from the first groove 138 to the second groove 140. When the projection 150 is in the second groove 140, a forward radial face of the ridge 134 may cooperated with a rearward radial face of the projection 150 to prevent the projection 150 from being removed from the second groove 140.

Meanwhile, the flanges 132 of the fingers 120 engage the tapered forward surface of the flange 152, and the continued relative axial movement between the outer conductor engager 102 and the body 104 causes the flange 152 to urge the fingers 120 radially inward onto the outer conductor 50 of the cable 4 in order to provide a reliable electrical and mechanical connection between the outer conductor engager 102 and the outer conductor 50.

Furthermore, forward movement of the compression ring 160 relative to the body 104 compresses the inner sleeve 162 on the outer jacket 52 of the cable 4. In particular, the compression ring 160 includes a rear ring portion 170 having an inner surface that has a first diameter at a forward portion 172, a second diameter at a rearward portion 174, and a tapered portion 176 from the larger first diameter to the smaller second diameter. As the compression ring 160 is moved forward relative to the body 104, the insert sleeve 162 bears against the body 104 and is prevented from moving with the compression ring 160. Thus, the compression ring 160 moves relative to the insert sleeve 162, and the relative axial movement causes the tapered portion 176 to radially compress the insert sleeve 162 to grip the outer jacket 52 of the cable 4 in order to prevent moisture and contaminants from entering the connector 100 between the compression ring 160 and the cable 4.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A connector for a coaxial cable, comprising:

a coupler configured to engage another coaxial cable connector;

a body configured to be disposed at least partially within the coupler;

an outer conductor engager made of a conductive material disposed within the body and the coupler;

wherein an interior of the body includes a biasing element;

wherein a compression sleeve is disposed at an opposite axial side of the outer conductor engager relative to the biasing element;

wherein the compression sleeve, the outer conductor engager, and the body are configured such that opposite axial forces applied to the compression sleeve and the outer conductor engager cause the outer conductor engager to move axially relative to the coupler and the body; and wherein the outer conductor engager is configured to be compressed by the biasing member when the outer conductor engager moves axially relative to the coupler and the body such that an interior surface of the outer conductor engager is compressed radially inward against an outer conductor of the coaxial cable.

2. The connector of claim 1, wherein the outer conductor engager further includes a flange on an exterior of the outer conductor engager that is configured to be compressed by the biasing element.

3. The connector of claim 1, wherein the outer conductor engager further includes fingers that are configured to be inwardly compressed by the biasing element.

4. The connector of claim 1, further comprising a sealing member retained between the coupler and the body.

5. The connector of claim 1, further comprising:

an insert sleeve disposed inside the compression sleeve, wherein the compression sleeve is configured to compress the insert sleeve against the coaxial cable when the axial force is applied to the compression sleeve.

6. The connector of claim 1, wherein the biasing element comprises a radially inward lip.

7. A connector for a coaxial cable, comprising:

a coupler configured to engage another coaxial cable connector;

a body configured to be disposed at least partially in the coupler;

an outer conductor engager made of a conductive material disposed in the body and the coupler;

a compression sleeve at an opposite axial side of the outer conductor engager relative to the coupler;

wherein the compression sleeve, the outer conductor engager, and the body are configured such that opposite axial forces applied to the compression sleeve and the outer conductor engager cause the outer conductor engager to move axially relative to the coupler and the body; and wherein the outer conductor engager is configured to be compressed by the body when the outer conductor engager moves axially relative to the coupler and the body such that an interior surface of the outer conductor engager is compressed radially inward against an outer conductor of the coaxial cable.

8. The connector of claim 7, wherein a radially inward lip extends from an interior of the body.

9. The connector of claim 8, wherein the outer conductor engager further includes a flange on an exterior of the outer conductor engager.

10. The connector of claim 9, wherein the flange is configured to be compressed by the radially inward lip.

11. The connector of claim 10, wherein the flange includes fingers that are configured to be inwardly compressed by the radially inward lip.

12. The connector of claim 7, further comprising a sealing member retained between the coupler and the body.

13. The connector of claim 7, further comprising:

an insert sleeve disposed inside the compression sleeve, wherein the compression sleeve is configured to compress the insert sleeve against the coaxial cable when the axial force is applied to the compression sleeve.

14. A connector for a coaxial cable, comprising:

a coupler configured to engage another coaxial cable connector;

a body configured to be disposed at least partially in the coupler;

an outer conductor engager made of a conductive material disposed in the body and the coupler;

wherein the outer conductor engager is configured to be moved axially relative to the coupler and the body; and wherein the outer conductor engager is configured to be compressed by an interior surface of the body when the outer conductor engager moves axially relative to the coupler and the body such that an interior surface of the outer conductor engager is compressed radially inward against an outer conductor of the coaxial cable.

15. The connector of claim 14, further comprising a compression sleeve at an opposite axial side of the outer conductor engager relative to the coupler.

16. The connector of claim 15, wherein the compression sleeve, the outer conductor engager, and the body are configured such that opposite axial forces applied to the compression sleeve and the outer conductor engager cause the outer conductor engager to move axially relative to the coupler and the body.

17. The connector of claim 16, wherein a radially inward lip extends from an interior of the body.

18. The connector of claim 17, wherein the outer conductor engager further includes a flange on an exterior of the outer conductor engager.

19. The connector of claim 18, wherein the flange is configured to be compressed by the radially inward lip.

20. The connector of claim 19, wherein the flange includes fingers that are configured to be inwardly compressed by the radially inward lip.

21. The connector of claim 14, further comprising a sealing member retained between the coupler and the body.

22. The connector of claim 14, further comprising:

an insert sleeve disposed inside the compression sleeve, wherein the compression sleeve is configured to compress the insert sleeve against the coaxial cable when the axial force is applied to the compression sleeve.

23. A connector for a coaxial cable, comprising:

a coupler;

a body configured to be disposed at least partially in the coupler;

an outer conductor engager made of a conductive material and configured to be disposed in the body and the coupler;

wherein the outer conductor engager is configured to receive a coaxial cable;

wherein the outer conductor engager is configured to be moved axially relative to the coupler and the body; and wherein the outer conductor engager is configured to be compressed by an interior surface of the body when the outer conductor engager moves axially relative to the coupler and the body such that an interior surface of the outer conductor engager is compressed radially inward against an outer conductor of the coaxial cable.

24. The connector of claim 23, further comprising a compression sleeve at an opposite axial side of the outer conductor engager relative to the coupler.

25. The connector of claim 24, wherein the compression sleeve, the outer conductor engager, and the body are configured such that opposite axial forces applied to the compression sleeve and the outer conductor engager cause the outer conductor engager to move axially relative to the coupler and the body.

26. The connector of claim 25, wherein a radially inward lip extends from an interior of the body.

27. The connector of claim 26, wherein the outer conductor engager further includes a flange on an exterior of the outer conductor engager.

28. The connector of claim 27, wherein the flange is configured to be compressed by the radially inward lip.

29. The connector of claim 28, wherein the flange includes fingers that are configured to be compressed inward against an outer conductor of the coaxial cable by the radially inward lip.

* * * * *